US006168030B1

(12) United States Patent
Morris

(10) Patent No.: US 6,168,030 B1
(45) Date of Patent: Jan. 2, 2001

(54) MULTIPLE MICROPHONE SUPPORT DEVICE

(76) Inventor: Tom O. Morris, 15011 Hartland St., Van Nuys, CA (US) 91405

( * ) Notice: Under 35 U.S.C. 154(b), the term of this patent shall be extended for 0 days.

(21) Appl. No.: 09/322,197

(22) Filed: May 28, 1999

(51) Int. Cl.[7] ..... A47F 7/00
(52) U.S. Cl. ..... 211/13.1
(58) Field of Search ..... 211/13.1, 26, 60.1, 211/1.51, 171; D14/229

(56) References Cited

U.S. PATENT DOCUMENTS

| | | | |
|---|---|---|---|
| D. 180,746 | 8/1957 | Oslac . | |
| D. 288,998 | 3/1987 | Wiggins . | |
| D. 293,203 | 12/1987 | Hertensteiner . | |
| D. 294,548 | 3/1988 | Wallace . | |
| D. 294,904 | 3/1988 | Bleskachek . | |
| D. 297,111 | 8/1988 | Thompson et al. . | |
| D. 334,387 | 3/1993 | Bostock et al. . | |
| D. 357,016 | 4/1995 | Li et al. . | |
| D. 384,077 | 9/1997 | Frasse . | |
| 1,225,525 | 9/1917 | Sweet . | |
| 3,363,864 | 1/1968 | Olgreen . | |
| 4,527,019 | 7/1985 | Lemp . | |
| 4,795,121 | 1/1989 | Comito . | |
| 4,828,121 | 5/1989 | Willcocks . | |
| 5,025,936 | 6/1991 | Lamoureaux . | |
| 5,244,700 | 9/1993 | Banschick . | |
| 5,360,194 | 11/1994 | Jacobson . | |
| 5,490,599 * | 2/1996 | Tohidi | 211/171 |

OTHER PUBLICATIONS

Photograph. Los Angeles Daily Journal newspaper, published on or about Jan. 18, 1999.

* cited by examiner

*Primary Examiner*—Alvin Chin-Shue
*Assistant Examiner*—Sarah Purol
(74) *Attorney, Agent, or Firm*—Knobbe, Martens, Olson & Bear, LLP

(57) ABSTRACT

A portable microphone stand for a large number of microphones is provided. This microphone stand is especially suitable for large press conferences that need to be set up and taken down quickly. A light weight "U" shaped support member is provided with two rows of openings of various sizes for receiving and holding microphones. The arrangement of the holes may be configured to orient the microphones towards the desired sound source.

20 Claims, 7 Drawing Sheets

MULTIPLE MICROPHONE SUPPORT DEVICE

FIELD OF THE INVENTION

This invention relates to an apparatus for supporting a plurality of microphones, and more particularly a microphone stand for multiple television and radio microphones.

BACKGROUND

A single newsworthy event, such as a press conference is often covered by a large number of news organizations. Each news organization has at least one of its own microphones. All the news organizations attempt to locate their microphones as close as possible to the sound of interest thereby causing a large number of microphones to be located in a relatively small space. Presently, the microphones are often wrapped together with duct tape, creating a cluster of microphones. However, this is inconvenient and cumbersome because the microphones are not securely fastened to one another or supported. Further, this microphone cluster must be created for each event and it is inconvenient to add a microphone for a late arriving reporter. Consequently, the microphones are more likely to be displaced or fall thereby damaging the microphones as well as preventing the owners of the microphones from picking up the desired sounds. Additionally, no convenient means exists to adjust the height of the cluster of microphones to an appropriate level near the sound source. The insecure support of the cluster of microphones increases the risk that the microphones may fall and not only fail to receive the desired sounds, but also incur damage. Also, after the users wish to separate the microphones by removing the duct tape, the glue from the duct tape leaves a sticky residue on the barrel of the microphones.

U.S. Design Pat. No. 384,077 by Frasse issued on Sep. 23, 1997 shows a microphone holder used to hold multiple microphones. The multiple microphone support of the present invention is a significant improvement over the microphone holder of Frasse.

SUMMARY

In accordance with this invention a lightweight, portable microphone support or stand is advantageously provided which allows a user, or multiple users, to conveniently and securely support a large number of various sized microphones at the desired height. One preferred embodiment of the invention comprises at least one, and preferably two curved hollow elongated members having a plurality of openings grouped in pairs. One opening of a pair is on the top surface of the hollow elongated member while the second opening of the pair is directly under the first opening, on the bottom surface of the hollow elongated member. The barrel of a microphone extends through a pair of openings. The elongated hollow members are curved in order to minimize the distance between the sound source and the microphones.

In another preferred embodiment of the invention, an elongated plate configured in an open "U" shape is provided. The plate may be relatively thin and made of any suitable material such as metal or plastic having sufficient strength to hold a large number of microphones. The plate preferably has a large number of openings therethrough spaced along the length of the plate to hold the microphones. The openings may advantageously be of a variety of sizes to accommodate a variety of microphone sizes. In another preferred embodiment, the plate may advantageously have a layer of foam on each side thereof with the opening through the foam layers oriented to direct the microphone to be held therein in the direction of the expected sound source. In an alternate preferred embodiment the plate may be made entirely of a relatively thick stiff foam material.

DETAILED DESCRIPTION OF THE PREFERRED EMBODIMENTS

Figures 2, 3, 4, 5, 6:
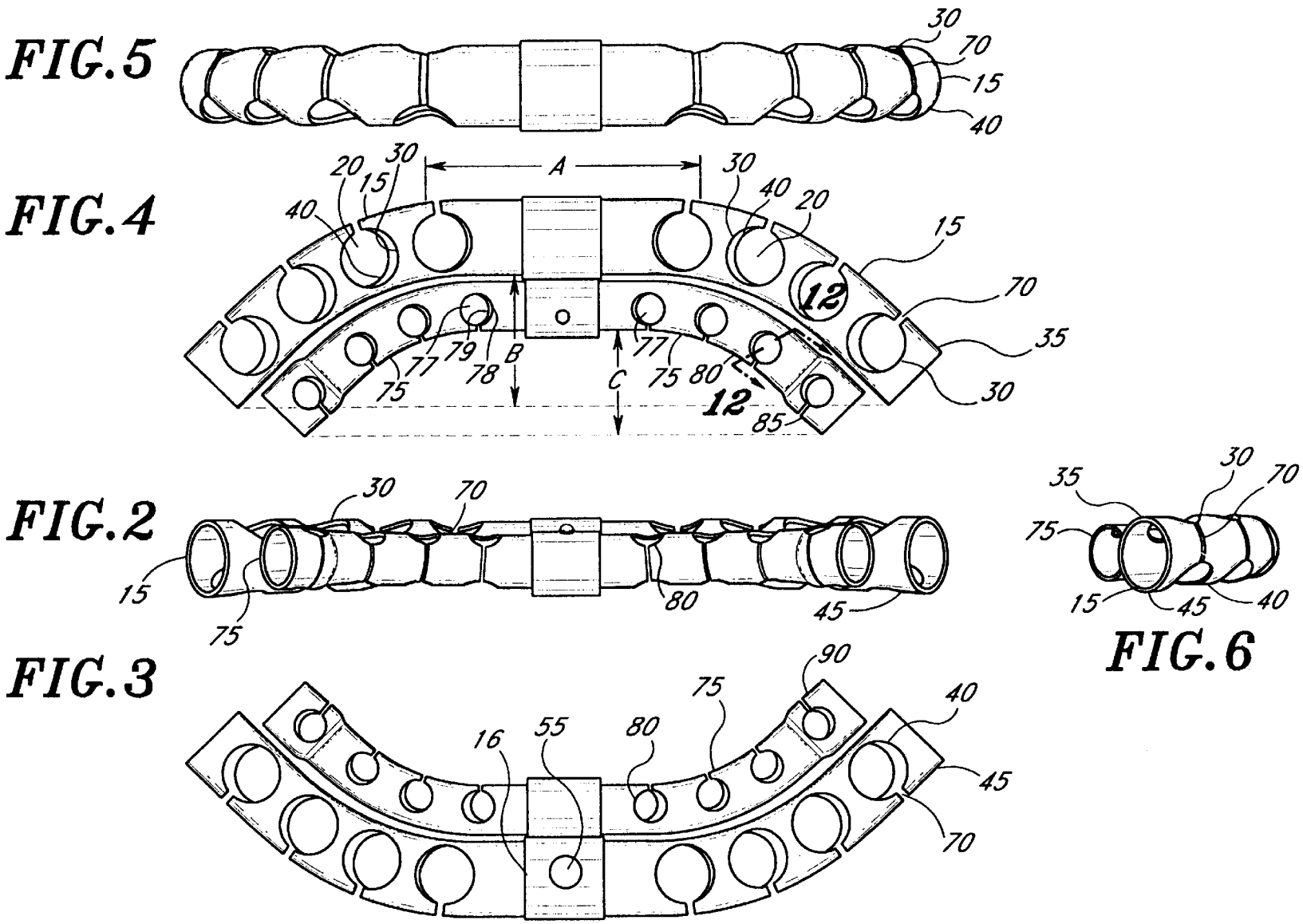
FIG. 2 is a front view of the multiple microphone support shown in FIG. 1.
FIG. 3 is a bottom view of the multiple microphone support shown in FIG. 1.
FIG. 4 is a top view of the multiple microphone support shown in FIG. 1.
FIG. 5 is a back view of the multiple microphone support shown in FIG. 1.
FIG. 6 is an end view of the multiple microphone support shown in FIG. 1.
Figure 12:
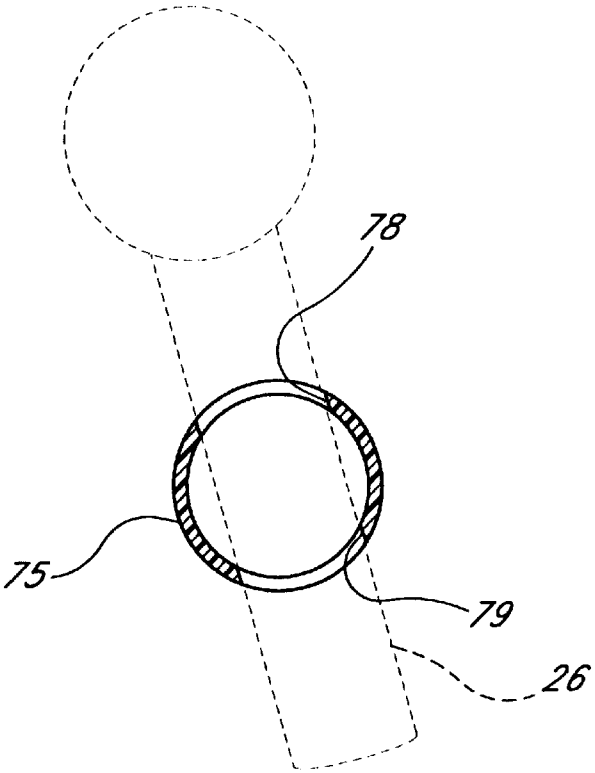
FIG. 12 is a cross-sectional view along line 12—12 of the microphone support shown in FIG. 4.

Referring now to the drawings, and in particular to FIGS. 1–6, one embodiment of a microphone support is indicated generally by the numeral 10. In a preferred embodiment, the support device comprises one elongated member 15 having a plurality of openings 20. As shown in FIGS. 1–6 and 10, the elongated member 15 may advantageously be two pipes joined at the ends with a standard coupler 16. The pipes may be made of any suitable material including plastic or metal. One suitable material is advantageously plastic PVC pipe. For example, a heavy duty 2 inch diameter PVC pipe such as a pipe made of a gray plastic called "Carlon" (UL listed 656A, CPLG E940J) may advantageously be used. Openings 20 are arranged along the length of joined pipes 15 to accommodate a series of microphones 25. Each opening includes an upper hole 30 through the upper portion of the pipe 15 and a lower hole 40 through the lower portion of the pipe 15. The upper and lower holes 30, 40 are offset a bit as can be seen in FIGS. 3, 4, and 12 so that each of the microphones will be tilted towards the expected source of the sound. The degree and orientation of the inclination changes depending on the location of the opening. In one embodiment a slit 23 may be formed on one side of the hole to permit the cord from the microphone to be inserted easily. Alternatively, the microphone wire, if any, can be attached after the microphone is placed in the opening provided for it and thus, no slit would be required.

In another preferred embodiment, a second smaller, elongated member 75 is advantageously provided adjacent the first larger elongated member 15. The second elongated member 75 is preferably made very similar to that of the larger elongated member. Thus, two pipes 75 of a diameter of about 1.5 inches each are joined together using a standard PVC connector 76. The openings 77 are provided by making holes 78, 79 in the upper and lower portions of the elongated member 75. The connectors 16 and 76 are advantageously joined using two bolts 97, 98 on the interior thereof as shown in FIG. 10C.

The microphone support 10 with two parallel pipes 15 and 75 may accommodate a wide range of different types of microphones, such as wireless, those with cords, and those having a variety of shapes. It is expected that the microphone support will be especially useful for radio and television microphones. The microphone support will also accommodate microphones useful for other purposes including public address, weddings and personal use, for example.

The elongated member 15 may have a circular, oval, square, or any other shaped cross-section. The elongated member 15 may be one piece inside two pieces connected in the middle and may be solid or hollow. The microphone support 10 may be made of either flexible or rigid materials that are lightweight, durable, and inexpensive. The length of the elongated member 15 is preferably curved such that the ends 50 of the elongated member 15 curve towards the same side. This configuration minimizes the distance between the microphones 25 placed in the support 10 and the person speaking into the microphones, which advantageously permits each of the microphones 25, 26 to optimally pick up the sound. However, the elongated member 15 may be formed into any configuration to locate the microphones 25 in a desired direction, such as a V shape or a U shape with a generally straight bottom and between a 90° and 160° turn at each of the ends of the flat bottom. The preferred range of angles for the angle between the flat bottom part of the "U" and the angled portions of the U shape is advantageously between 130° and 150°, and more preferably about 140°. The length of the generally straight bottom "particle" may advantageously be in the range of five (5) to twenty (20) inches and more preferably between about 8 and 15 inches.

Figure 13:
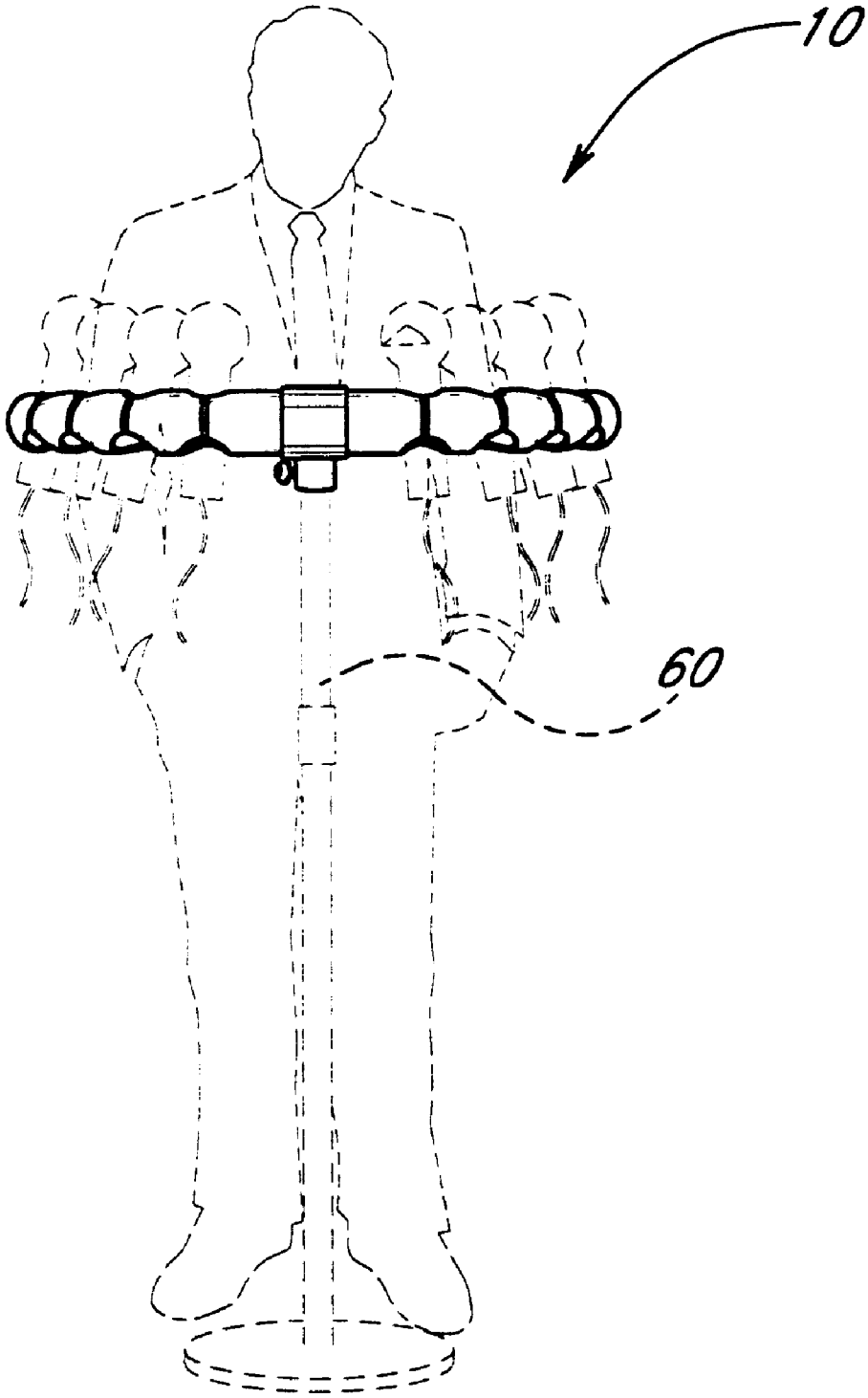
FIG. 13 shows the microphone support of FIG. 1 in a sample use.

In FIGS. 1–6, the U shape of elongated member 15 is formed with a straight portion in the center indicated by the letter A in FIG. 4 and two curved portions, one on each side of the straight portion. The curved portions extend inwardly to form a "U" shape so as to permit the microphones to be proximate to the expected sound source of, for example, an individual speaking at a press conference (see FIG. 13). At the opposite end of the elongated member 15, the microphone support includes straight portions, each of which form an angle with the straight portion of the center of the elongated member of about 136°. The ends of the elongated member 15 extend inwardly from the flat portion by an amount shown as B in FIG. 4. In one embodiment, the dimension A may be about eight (8) inches and the dimension B may be about four (4) inches. It is contemplated that the dimension A could range from zero to 16 inches or more and that the dimension B may range from about one inch to 20 inches or more. Advantageously, the dimension A will be in the range of from 2 inches to 6 inches and the dimension B will be in the range of from 3 inches to 6 inches.

The second elongated member 75 fits just inside elongated member 15. Elongated member 75 has a flat portion and a curves portion much like that of elongated member 15, but sized to run inside and parallel to elongated member 15. The dimension C indicates the amount by which the ends of inside elongated member extend inwardly. In the embodiment where B is about four (4) inches, the dimension C is about two and three-fourths (2¾) inches. It is contemplated that dimension C could range from about one-half (½) inch to twelve (12) inches or more. Advantageously, the dimension C will be in the range from 2 inches to 4 inches.

The cross section of the elongated member 15 may be any shape which allows for two coaxial openings. For reference, if the length of the hollow elongated member 15 is oriented parallel to the ground, the opening pairs 30, 40 are located such that the first opening 30 of the opening 20 is on the top surface 35 of the hollow elongated member 15 and the corresponding second opening 40 of the opening 20 is under the first opening 30 on the bottom surface of the hollow elongated member 15. The second opening 40 is placed under the first opening 30 such that a microphone held in the opening is oriented inwardly, towards the speaker.

Microphones come in all shapes and sizes. Where it is expected that some or all of the microphones will have tapered barrels such that the bottom of the barrel has a smaller diameter than the top of the barrel, the diameter of each of the first openings 30 will be made smaller than the diameter of the thickest portion of the barrel of the microphone 25 but greater than the diameter of the narrowest portion of the barrel of each of the microphones 25. The diameter of each of the second openings 40 is greater than the diameter of the narrowest portion of the barrel of each of the microphones 25 and somewhat smaller than the openings 30.

The narrowest portion of the barrel of one of the microphones 25 is first directed through one of the first openings 30 and then through one of the second openings 40 so that the microphone 25 is cooperatively supported by both top 35 and bottom surfaces in a generally upward position, slanted toward the expected sound source. Ideally, the relationship between the sizes of the openings 30, 40 correspond to the tapered barrel so that the microphone barrel 25 is snugly supported in two separate locations along the length thereof. This provides support and security for the microphones to remain in the desired position, as compared to a microphone stand which supports the microphone around only one area of the barrel such as that shown in U.S. Design Pat. No. 384,077. The openings 30, 40 are arranged in a row along the length of the hollow elongated member 15 with enough space between adjacent openings to ensure structural integrity of the device 10.

Frequently, a cord 65 is present on the bottom of the barrel 25 of each microphone to connect the microphone 25 to an amplifier. To facilitate placement of the barrel 25 in the device 10 without the necessity of disconnecting the cord or threading the entire length of the cord 65 through the pair of openings 30, 40, the opening 20 may have a keyhole shape with a slot 70 on one side thereof. Each slot 70 runs in a direction normal to the opening's perimeter 30 around the circumference of the hollow elongated member 15 until it connects to the perimeter of the other opening 40. Consequently, a user first laterally passes the cord 65 through the slot 70 before vertically placing the barrel 25 through the pair of openings 30, 40.

Figure 1:
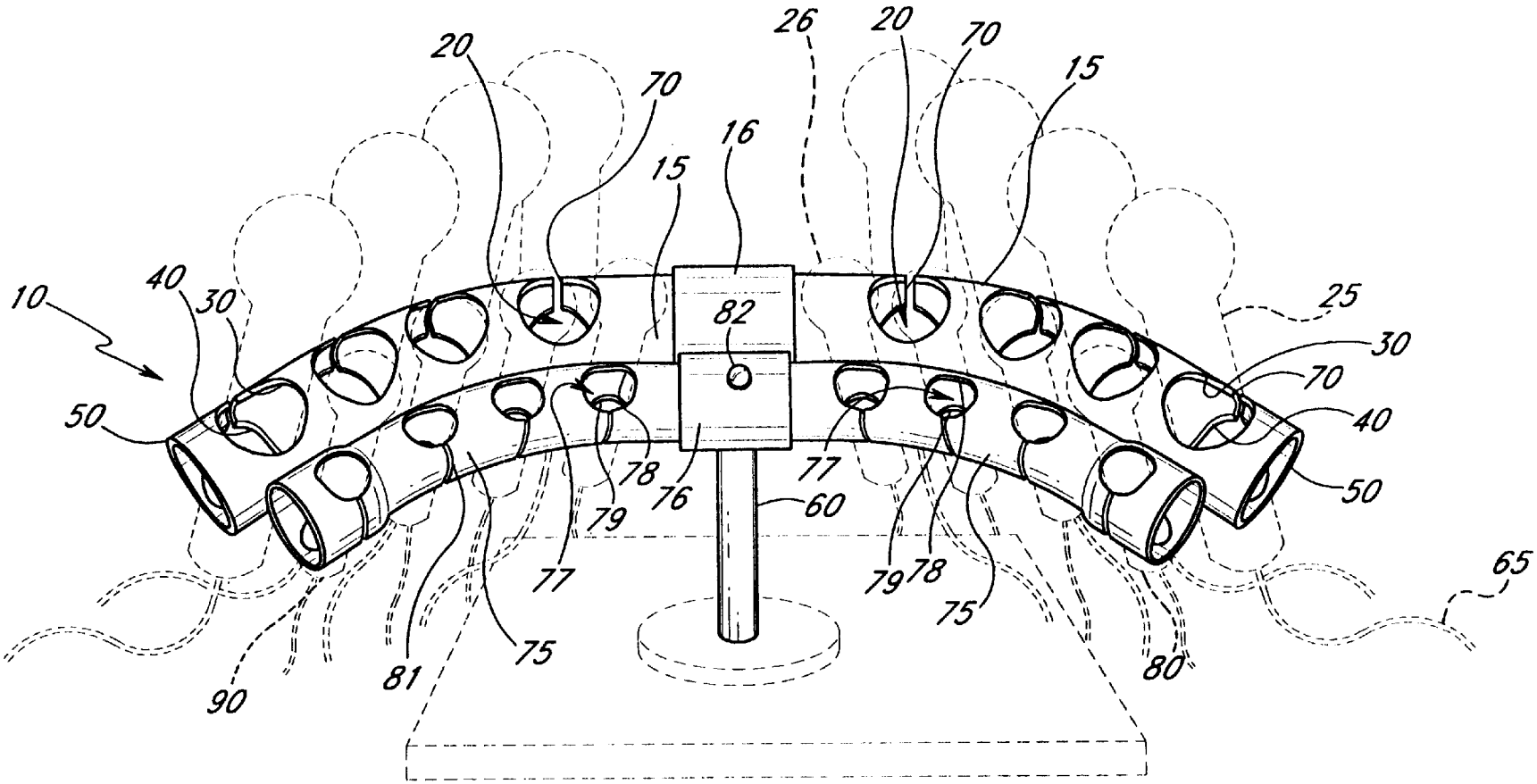
FIG. 1 is a perspective view of a multiple microphone support made in accordance with the invention.

As discussed above, the device 10 may further comprise a second cunred elongated member 75. As shown in FIG. 10, the central connector portion 76 of the second elongated member 75 is preferably connected to the central connector portion 16 of the first elongated member 15 using two sets of nuts and bolts 77, 78 where the bolts extend through both the first and second members, 15 and 75 respectively. Glue, nails, welding, cords, rivets, or other fasteners known to those skilled in the art may also be used. The second elongated member 75 may be similar in size or shape to the first elongated member 15 or may have a cross section of a different diameter than the first elongated member 15, or the openings 78, 79 on the top and bottom surfaces of the second elongated member 75 may have a different diameter than the opening pairs 30, 40 of the first elongated member 15. The variation in size of the second elongated member 75 allows the microphone support 10 to accommodate differently sized microphones 25, 26. The microphone support 10 may also have an opening 55 at the center of the bottom thereof which interfaces with the top of an adjustable stand 60 so that the device 10 may be adjusted to an appropriate height to maximally pick up the desired sound. The stand 60 may be made adjustable in any well known manner. For example, the stand may be made of two telescoping poles which are selectively held at the desired height with a twistable clamp. The stand 60 may be a table stand as shown in FIG. 1 or a floor stand 60 as shown in dotted lines in FIG. 13.

The opening 55 in the bottom of connector 16 may be simply sized to fit on top of most existing table or floor stands. The top of the pole of the stand, when in contact with the inside top of the connector 16 and the sides of opening 55, provides stability for the microphone support. This stability may advantageously be enhanced by providing a mating pin or sleeve (not shown) in the inside top of the connector 16 matable with the pole of the stand to hold the top of the pole in position.

Figures 9, 10A, 10B:
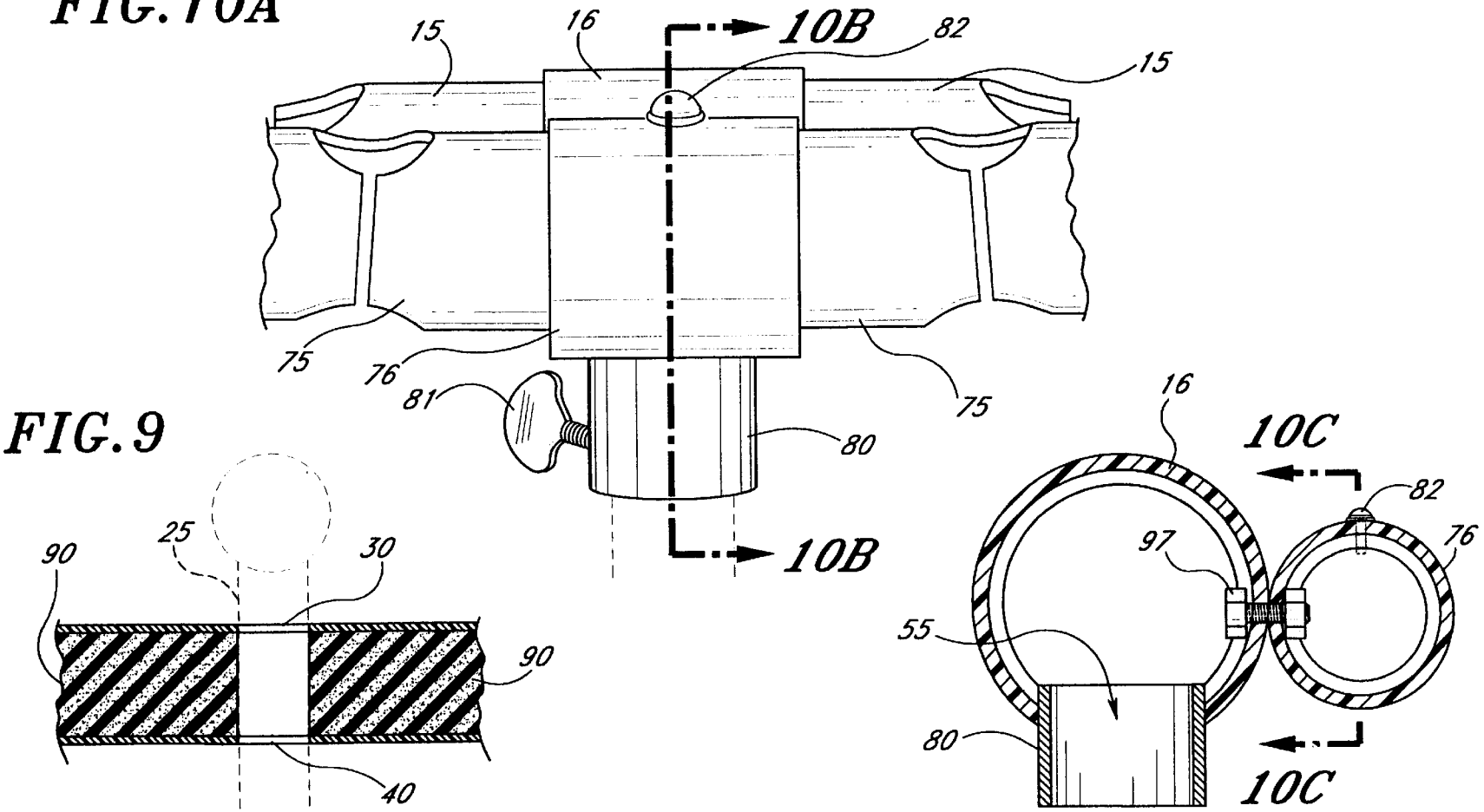
FIG. 9 shows an alternate embodiment of the multiple microphone support shown in FIG. 1.
FIG. 10A is a view of the central portion of the microphone support of FIG. 1.
FIG. 10B is a cross-sectional view along lines 10B—10B of FIG. 10A.
Figure 10C:
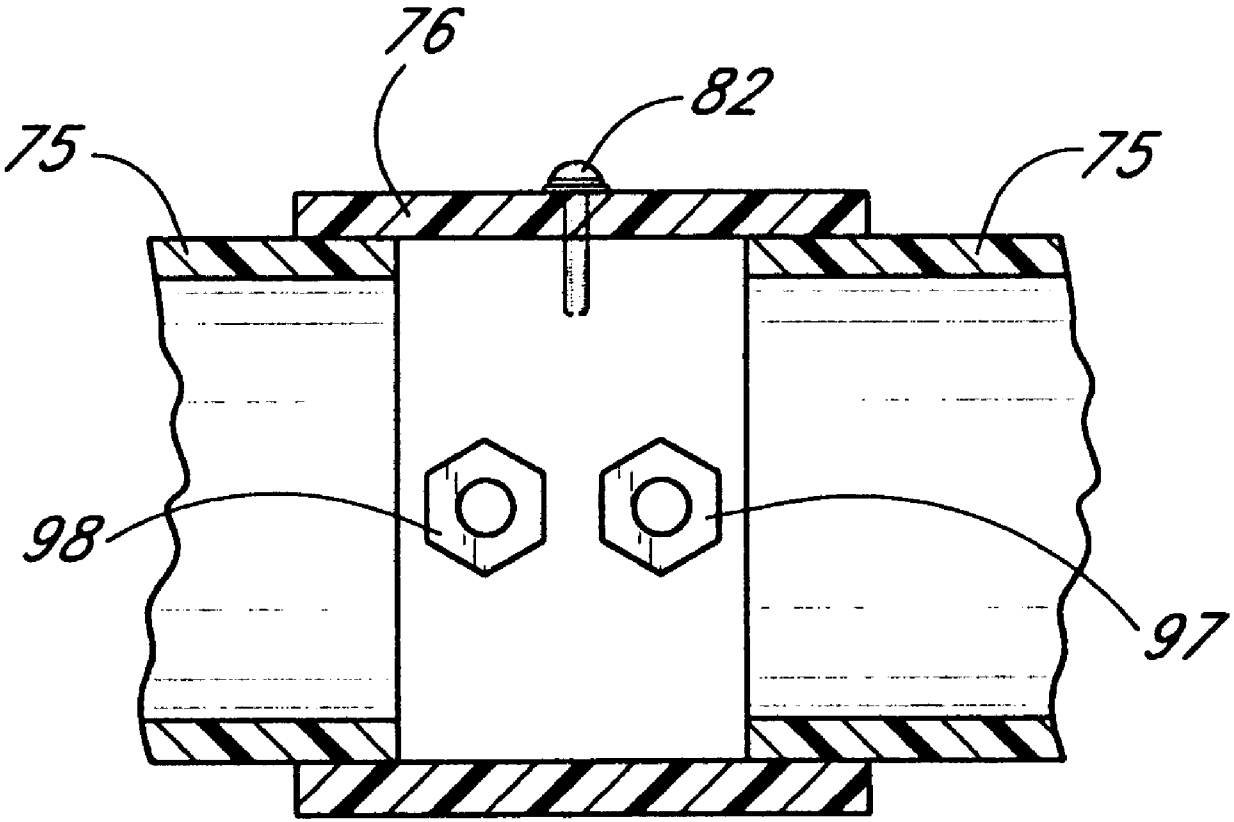
FIG. 10C is a cross-sectional view along lines 10C—10C of FIG. 10B.

Alternatively, a sleeve 80 may advantageously be provided extending into opening 55 and secured thereto in any well known manner such as welding or gluing as shown in FIGS. 10A and 10B. Additionally, a screw clamp 81 may advantageously be provided to hold the microphone support in place. Where the stand is not itself adjustable, an opening (not shown) may be formed in the top of the connector 16 to permit the height of the support 10 to be adjusted up and down by allowing the pole of the stand to extend through elongated member 15.

A screw 82 may be placed in the top of connector 76 (the middle of the second elongated member 75) to hold a clipboard for speaker notes or to mount another type of microphone. In another preferred embodiment soft foam 90 of the type used for camera cases may advantageously be provided inside the elongated members 15, 75 to help hold the microphones in place as is shown in FIG. 9. This is particularly helpful where the barrels of the microphones are not tapered. The foam, in its uncompressed condition would extend slightly into the openings 20 so that when the microphone 25 is placed in one of the openings, the foam is compressed about the surface of the microphone, thus helping to hold it in place.

The diameter of the openings 20, may also vary within a single hollow elongated member. The shape of the openings 20 may be circular, square, triangular, or any other suitable shape to accommodate the barrel 25 of each of the microphone. Furthermore, the inner edges of the openings 30, 40 may advantageously be lined with a soft compressible material, such as sponge or foam (not shown), to cushion the barrel 25 and to provide additional support to hold the microphone in place.

Figure 11:
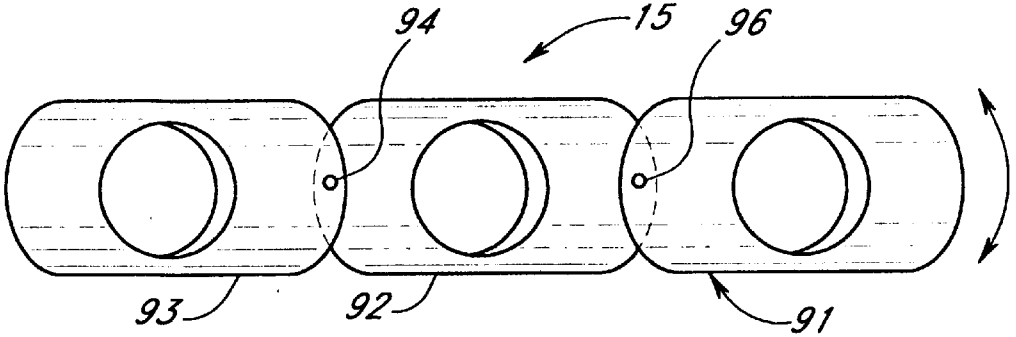
FIG. 11 is a partial view of an alternative embodiment of a microphone support which permits the curvature of the microphone support to be adjusted.

In order to provide more flexibility in positioning the microphones, the elongated member or tube 15 may in an alternate embodiment advantageously be made in sections which pivot with respect to one another. Three pivotable sections 91, 92, 93 are shown in FIG. 11. The pivot pins 94 and 96 may be friction fitted so that when the sections 91, 92, 93 are positioned in a desired orientation, they stay in place. Alternatively, individual screw clamps or clips may advantageously be used for releasing and holding the sections in place.

Figure 7B:
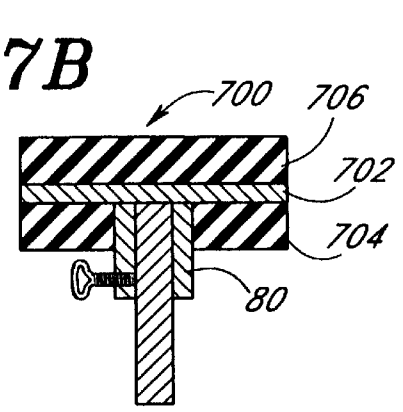
FIG. 7B is a cross-sectional view along line 7B—7B of the multiple microphone support shown in FIG. 7A.
Figure 7A:
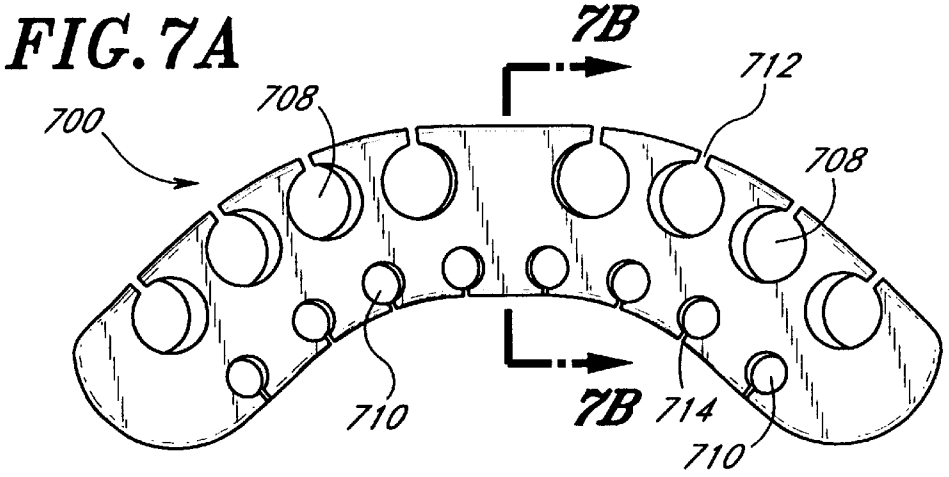
FIG. 7A shows an alternative embodiment of a multiple microphone support.
Figure 8:
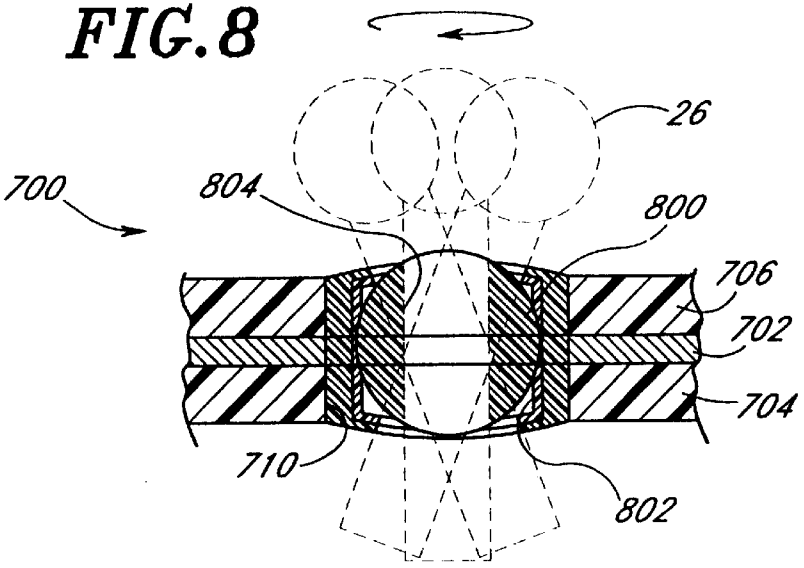
FIG. 8 shows an alternate embodiment for holding a microphone which permits adjustment of the microphone orientation.

Turning now to FIGS. 7 and 8, another preferred embodiment will be disclosed. Instead of using PVC pipes, it's contemplated that advantages of the invention may be achieved using a variety of materials and structures. Thus, in FIG. 7A, a "U" shaped microphone support 700 is provided which accommodates a large number of microphones of varying sizes. The support is advantageously made in a sandwich form with a stiff, flat center spine 702 surrounded by foam plastic layers 704 and 706. The center spine advantageously extends substantially throughout the extent of the support and is provided with holes 708, 710 for microphones. The foam layers 704, 706 may advantageously be of a soft foam of the type found in equipment cases (such as camera cases) or of a stiffer variety of foam of the type found useful for packing stereo equipment and the like. The general shape of the plate 700 and the orientation of the openings 708, 710 follows that described for the microphone support shown in FIGS. 1–6.

FIG. 8 shows an alternative embodiment permitting adjustment of the orientation of the microphone. Some or all of the openings 708 and 710 may include a ball 800 and a bearing sleeve 802 to permit joy-stick type movement of a microphone inserted in an opening 804 which extends through the ball. The same pivotable microphone support shown in FIG. 8 could also be used in the openings of the microphone support 10 of FIGS. 1–6.

In one preferred embodiment (not shown), the microphone support is made of a flexible material, such as a dense foam or a material of similar flexibility known to those of ordinary skill in the art. The flexible support may include a heavy bendable wire (not shown) internally located along the length of an elongated solid piece of foam. The wire permits the flexible microphone support to be bent into any desired configuration to immediately accommodate a variety of environments for sound pickup. The openings in the flexible device are advantageously smaller than the diameter of the barrel of the microphone, but can stretch to accommodate and help hold the barrel of the microphone upon insertion.

In yet another preferred embodiment, the multiple microphone support device 10 advantageously comprises at least two surfaces (not shown). The surfaces are preferably formed by two flat plates oriented parallel to one another and spaced from one another. A distance less than the length of the barrel of the expected microphones 25 separates the two surfaces. The top surface has a plurality of first openings, and the bottom surface has a plurality of second openings such that each of the second openings is located under one of the first openings. The barrel of a microphone is placed through one of the first openings and then through the corresponding second opening so that the barrel is held in position by the edges of the two openings.

The two surfaces may be connected by a plurality of spacers located between the two surfaces, a third surface perpendicular to the two surfaces, wherein one edge of the third surface is aligned with an edge of the first surface and another edge of the third surface is aligned with an edge of the second surface, or any number of surfaces joining the top and bottom surfaces.

While the invention has been disclosed in the context of several preferred embodiments, it is contemplated that the invention includes other embodiments that utilize the inventive concepts disclosed herein.

What is claimed is:

1. A microphone stand capable of holding a large number of microphones comprising:

an elongated tube having two ends and a central portion, a series of openings in said tube sized to accommodate microphones of the type used professionally by radio and television news teams, said tube formed in a U shape such that all the microphone openings are arranged close to the expected source of the sound.

2. The microphone stand of claim 1 wherein the openings in the tube for the microphones include a hole at the upper and lower sides of the tube, and at least some of the upper and lower holes are offset to direct the microphone towards the expected source of the sound.

3. The microphone stand of claim 1 further comprises a second elongated tube secured adjacent and in a generally parallel position in relation to the first mentioned elongated tube, said second tube having a series of opening to accommodate and hold microphones.

4. The microphone stand of claim 3 wherein the second tube has a smaller diameter than the first tube.

5. A multiple microphones support apparatus comprising:

a "U" shaped support having a top surface and a bottom surface,each of said first openings being associated with one of said second openings to form an opening through the U-shaped support, the openings being arranged to minimize the distance between each of said openings and a sound source, whereby said narrowest portion of the barrel of each of said microphones may first be directed through said first opening and then into said second opening so that said microphone is supported cooperatively by sid top and bottom surfaces.

6. The apparatus of claim 1, wherein said first plurality of openings and said second plurality of openings are arranged on the hollow elongated member to minimize the distance between a desired sound source and each of said openings.

7. The apparatus of claim 6, wherein the unitary structure is a hollow elongated member.

8. The apparatus of claim 3, wherein said first plurality of openings are arranged in an arc on the top surface to minimize the distance between said desired sound source and said first plurality of openings of the hollow elongated member and desired sound source.

9. The apparatus of claim 7, wherein the hollow elongated member is cylindrical.

10. The apparatus of claim 5, wherein said first plurality of openings are arranged in a curved arc on the top surface to minimize the distance between said first openings near the ends of the surface and a desired sound source.

11. The apparatus of claim 5, wherein said apparatus further comprises means for adjusting the height of said apparatus so that the microphones may be located at a desired height.

12. The apparatus of claim 10, wherein the means for adjusting the height of said apparatus is an opening at the center of the bottom surface for interfacing with an adjustable stand such that the apparatus rests upon the top of the stand.

13. The apparatus of claim 5, wherein each of said first openings is keyhole shaped, and each of said second openings is keyhole shaped for acceptance of a cord attached to said microphone.

14. The apparatus of claim 7, wherein each of said first openings is keyhole shaped, and runs from the edge of said first opening around the perimeter of said hollow elongated member to the edge of said second opening for acceptance of a cord attached to said microphone.

15. The apparatus of claim 7, wherein the apparatus is attached to a second hollow elongated member of a different diameter along the length of said apparatus, the top surface of said second hollow elongated member having at least one first opening for receiving an additional microphone, the diameter of said first opening of said second hollow elongated member being smaller than the diameter of the thickest portion of the barrel of said additional microphone but greater than the diameter of the narrowest portion of the barrel of said additional microphone, the bottom surface of said second hollow elongated member having at least one second opening for receiving said additional microphone, the diameter of said second opening being greater than the diameter of the narrowest portion of the barrel of said additional microphone.

16. The apparatus of claim 14, wherein the openings in the second hollow elongated member support wireless radio microphones are a different diameter than the openings in the first hollow elongated member.

17. The apparatus of claim 5, wherein a soft material lines the interior of each opening to protect and secure said barrel of each of said microphones.

18. An multiple microphone support apparatus comprising:

a hollow elongated member including a top surface having at least one first keyhole shaped opening running from the edge of said first opening around half the boundary of hollow elongated member to the edge of said second opening located on the bottom surface of said hollow elongated member for acceptance of a cord attached to said microphone, said hollow elongated member being curved to minimize the distance from the first and second openings, near the ends of the hollow elongated member, to a desired sound source, the diameter of said first opening being smaller than the diameter of the thickest portion of the barrel of said microphone but greater than the diameter of the narrowest portion of the barrel of said microphone, and the diameter of said second opening being greater than the diameter of the narrowest portion of the barrel of a microphone, whereby the narrowest portion of said barrel of said microphone may first be directed through said first opening and then into said second opening so that said microphone is supported cooperatively by said first and second surfaces in a substantially vertical position.

19. A method for supporting a plurality of microphones with an apparatus comprising the steps of:

resting said apparatus onto an adjustable stand;

directing the barrel of one of said plurality of microphones through an opening in a top surface of said apparatus;

directing the barrel of one of said plurality of microphones through an opening in a bottom surface of said apparatus until said microphone is surrounded by the top surface and bottom surface of said apparatus; and moving a wire located on the bottom of one of said plurality of microphones through a slot associated with each opening.

20. A multiple microphone support apparatus comprising:

a first surface, said surface having a plurality of openings, the diameter of the openings being less than the largest diameter of the barrel of a microphone, said plurality of openings arranged to minimize the distance between each of said plurality of openings and a desired sound source whereby each of said openings receive one of said plurality of microphones, a second surface separated by a distance from said first surface and said second surface having a plurality of openings whereby said narrowest portion of said barrel of one of said microphones may first be directed through one of said openings of the first surface and then through one of said openings of the second surface so that said microphone is supported cooperatively by said top and bottom surfaces.

* * * * *

UNITED STATES PATENT AND TRADEMARK OFFICE

CERTIFICATE OF CORRECTION

PATENT NO. : 6,168,030 B1
DATED : January 2, 2001
INVENTOR(S) : Tom O. Morris

It is certified that error appears in the above-identified patent and that said Letters Patent is hereby corrected as shown below:

Column 7, claim 5,
Line 41, change "by sid" to -- by said --

Signed and Sealed this

Eleventh Day of December, 2001

*Attest:*

Nicholas P. Godici

NICHOLAS P. GODICI
*Acting Director of the United States Patent and Trademark Office*

*Attesting Officer*